US005360023A

United States Patent [19]

Blakley et al.

[11] Patent Number: 5,360,023

[45] Date of Patent: Nov. 1, 1994

[54] CIGARETTE FILTER

[75] Inventors: Richard L. Blakley, Pfafftown; Gary R. Shelar, Greensboro; Jeffery S. Gentry, Pfafftown; Gary W. Worrell, Tobaccoville; Thomas A. Perfetti, Winston-Salem, all of N.C.

[73] Assignee: R. J. Reynolds Tobacco Company, Winston-Salem, N.C.

[21] Appl. No.: 898,111

[22] Filed: Jun. 12, 1992

Related U.S. Application Data

[63] Continuation-in-part of Ser. No. 408,433, Sep. 15, 1989, Pat. No. 5,137,034, which is a continuation of Ser. No. 194,696, May 16, 1988, abandoned, and Ser. No. 759,266, Sep. 13, 1991, Pat. No. 5,271,419, which is a continuation-in-part of Ser. No. 414,833, Sep. 29, 1989, Pat. No. 5,074,321.

[51] Int. Cl.[5] ..... A24D 3/04

[52] U.S. Cl. ..... 131/331; 131/342; 131/339

[58] Field of Search ..... 131/331, 342, 341, 335, 131/339, 365; 55/16, 68, 74, 75, 98

[56] References Cited

U.S. PATENT DOCUMENTS

| | | | |
|---|---|---|---|
| 2,164,702 | 7/1939 | Davidson . | |
| 2,669,995 | 2/1954 | Troy . | |
| 2,801,638 | 8/1957 | Schur et al. | 131/339 |
| 2,832,351 | 4/1958 | Hale . | |
| 2,881,770 | 4/1959 | Touey . | |
| 2,916,039 | 12/1959 | Muller . | |
| 3,101,723 | 8/1963 | Seligman et al. . | |
| 3,169,535 | 2/1965 | Lassiter et al. . | |
| 3,217,715 | 11/1965 | Berger et al. . | |
| 3,236,244 | 2/1966 | Irby, Jr. et al. . | |
| 3,251,365 | 5/1966 | Keith, II et al. . | |
| 3,318,317 | 5/1967 | Sproull et al. . | |
| 3,319,630 | 5/1967 | Orrmins . | |
| 3,347,247 | 10/1967 | Lloyd . | |
| 3,351,107 | 11/1967 | Belfort . | |
| 3,744,496 | 7/1973 | McCarty et al. . | |
| 3,744,497 | 7/1973 | Marciuliano . | |
| 3,902,504 | 9/1975 | Owens, Jr. et al. . | |
| 3,972,335 | 8/1976 | Tiggelbeck et al. . | |
| 4,125,061 | 11/1978 | Goavec et al. . | |
| 4,195,649 | 4/1980 | Nogachi et al. . | |
| 4,225,636 | 9/1980 | Cline et al. . | |
| 4,291,711 | 9/1981 | Berger . | |
| 4,481,958 | 11/1984 | Rainer et al. . | |
| 4,505,282 | 3/1985 | Cogbill et al. . | |
| 5,137,034 | 8/1992 | Perfetti et al. . | |

FOREIGN PATENT DOCUMENTS

| | | |
|---|---|---|
| 951510 | 8/1962 | United Kingdom . |

*Primary Examiner*—Jennifer Bahr

[57] ABSTRACT

Cigarettes include a filter element which have a gathered web of paper incorporating a carbonaceous material. The paper is gathered so as to include a plurality of longitudinally extending channels, and the channels provide a cross-sectional void area of about 5 to about 30 percent of the filter element.

29 Claims, 3 Drawing Sheets

CIGARETTE FILTER

CROSS-REFERENCE TO RELATED APPLICATION

This is a continuation-in-part of co-pending U.S. patent application Ser. No. 07/408,433, filed Sep. 15, 1989, now U.S. Pat. No. 5,137,034, which is a continuation of U.S. patent application Ser. No. 07/194,696 filed May 16, 1988, now abandoned; and of co-pending U.S. patent application Ser. No. 07/759,266 filed Sep. 13, 1991, now U.S. Pat. No. 5,271,419, which is a continuation-in-part of U.S. patent application Ser. No. 07/414,833, filed Sep. 29, 1989, now U.S. Pat. No. 5,074,321; the disclosures of which are incorporated herein by reference.

BACKGROUND OF THE INVENTION

The present invention relates to smoking articles such as cigarettes, and in particular, to cigarettes having filter elements containing a carbonaceous material.

Popular smoking articles, such as cigarettes, have a substantially cylindrical rod shaped structure and include a charge of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco road. Typically, a filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Cigarettes are employed by the smoker by lighting one end thereof and burning the tobacco rod. The smoker then receives mainstream smoke into his/her mouth by drawing on the opposite end (e.g., the filter end) of the cigarette.

Certain cigarettes have filter elements which incorporate materials such as carbon. Exemplary cigarettes and filters therefor are described in U.S. Pat. Nos. 3,353,543 to Sproull et al. and 4,481,958 to Ranier et al. Certain commercially available filters have particles or granules of carbon (e.g., an activated carbon material or an activated charcoal material) dispersed within cellulose acetate tow; other commercially available filters have carbon threads dispersed therein; while still other commercially available filters have so-called "cavity filter" or "triple filter" designs. Exemplary commercially available filters are available as SCS IV Dual Solid Charcoal Filter from American Filtrona Corp.; Triple Solid Charcoal Filter from FIL International, Ltd.; Triple Cavity Filter from Baumgartner; and ACT from FIL International, Ltd.

Cigarette filter elements which incorporate carbon have a propensity to remove certain gas phase components from the mainstream smoke which passes through the filter element during draw by the smoker. However, aerosol particles of the smoke can have a tendency to interact with the carbon present within such conventional filter elements, thereby causing such aerosol particles to undergo a change in their chemical and physical character or nature. Such a change in the nature or character of aerosol particles of the mainstream smoke results in a change in the organoleptic properties of the mainstream smoke. For example, the mainstream tobacco smoke which is filtered using a conventional cigarette filter element incorporating carbon can often be characterized as having slightly metallic, drying and powdery flavor characteristics.

It would be desirable to provide a cigarette filter element which is capable of removing significant amounts of certain gas phase components of mainstream cigarette smoke, while not adversely affecting the flavor of that mainstream smoke to any significant degree.

SUMMARY OF THE INVENTION

Certain cigarettes of the present invention include a charge or roll of smokable material contained in two layers of circumscribing outer wrapping materials to form a so-called "tobacco rod." The tobacco rod is such that a first (i.e., inner) wrapping material circumscribes the smokable material, and a second (i.e., outer) wrapping material circumscribes the first wrapping material. Certain other cigarettes of the present invention include a charge or roll of smokable material contained in a single layer of circumscribing wrapping material to form a tobacco rod.

The smokable material is a smokable filler material comprising tobacco cut filler material. Normally, the smokable material is all tobacco cut filler material, and preferably that cut filler material has been cased and/or top dressed.

Cigarettes of the present invention each include a filter element which acts as a mouthpiece. The filter element includes a carbonaceous material. The filter element preferably includes two or more filter segments which are longitudinally positioned within the filter element; and at least one of the filter segments includes a carbonaceous material (e.g., an activated carbon material or an activated charcoal material in a powdered or fine grain form). The carbonaceous material preferably is incorporated into the filter segment as a component of a paper (e.g., the paper includes a carbonaceous material as a component thereof). The filter segment including the carbonaceous material is constructed so as to have a plurality of longitudinally extending channels or air passageways extending entirely through that filter segment. The channels or air passageways are of a cross-sectional area such that particulate phase components of mainstream smoke passing through the filter segment are not filtered by or do not interact to a significant degree with the carbonaceous material, while significant amounts of gas phase components of the mainstream smoke can be removed by the carbonaceous material of that filter segment. Typically, the filter segment including the carbonaceous material is provided as a gathered paper web.

Cigarettes optionally can be air diluted (e.g., by perforating the tipping material in the region which overlies the filter elements or by other such air dilution means). When air diluted, the filter element normally is ventilated to provide a cigarette having an air dilution between about 25 and about 75 percent. As used herein, the term "air dilution" is the ratio (expressed as a percentage) of the volume of air drawn through the air dilution means to the total volume of air and smoke drawn through the cigarette and exiting the extreme mouthend portion of the cigarette. See, Selke, et al., *Beitr. Zur Tabak. In.*, Vol. 4, p. 193 (1978).

Filter segments incorporating carbonaceous materials also can be incorporated into those types of cigarettes described in U.S. Pat. No. 5,027,837 to Clearman et al.

DETAILED DESCRIPTION OF THE PREFERRED EMBODIMENTS

Figure 1:
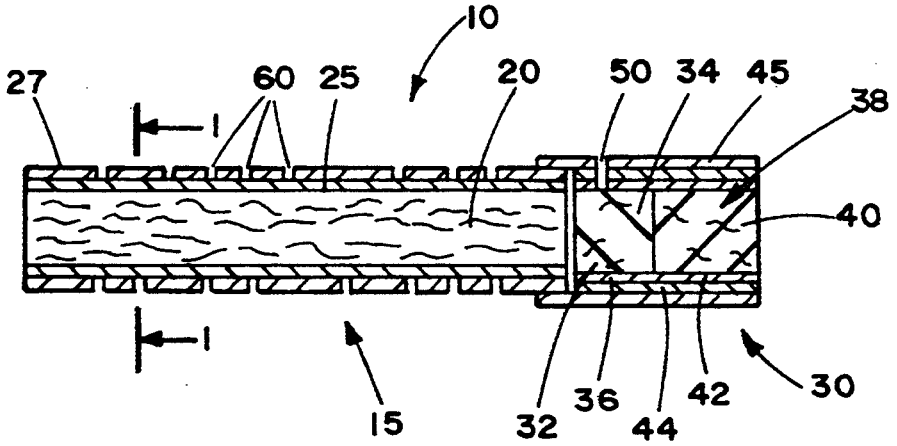
FIG. 1 is a longitudinal sectional view of a cigarette of the present invention.

One preferred embodiment of a cigarette of the present invention is shown in FIG. 1. The cigarette 10 includes a generally cylindrical rod 15 of smokable material 20, such as tobacco cut filler, contained in a first circumscribing inner wrapping material 25 and a second or outer wrapping material 27 circumscribing the first wrapping material. The first and second circumscribing wrapping materials directly contact one another (i.e., the inner surface of the outer wrapping material contacts the outer surface of the inner wrapping material). As such, the outer wrapping material overwraps the inner wrapping material. The rod 15 is hereinafter referred to as a "tobacco rod." The ends of the tobacco rod 15 are open to expose the smokable material. The tobacco rod is used by lighting one end thereof, and aerosol (e.g., smoke) is provided as a result of the combustion of the burning smokable material 20. As such, the tobacco rod burns back from the lit end thereof towards the opposite end (i.e., mouthend) thereof, and the smokable material of the tobacco rod is consumed by combustion during the smoking period.

The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough.

The filter element includes two filter segments which are aligned in an end-to-end relationship, preferably abutting one another. A first filter segment 32 is positioned adjacent the tobacco rod; and includes a first filter material 34, such as a gathered carbon paper. The first filter material 34 is circumscribed by a wrapping material 36, such as paper plug wrap. A second filter segment 38 is positioned at the extreme mouthend of the cigarette; and includes a second filter material 40, such as gathered cellulose acetate web, plasticized cellulose acetate tow, gathered polyester web, gathered polypropylene web or polypropylene tow. The second filter material 40 is circumscribed by a wrapping material 42, such as a paper plug wrap. The second filter material 40 provides an aesthetically pleasing, white appearance. Each of the filter segments is manufactured using known filter rod making machinery. The two segments are combined using known plug tube combining techniques (e.g., using a Mulfi from Hauni-Werke Korber & Co., K.G.), and are held together using circumscribing outer wrapping material 44 (e.g., paper plug wrap) so as to form the filter element 30.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the outer plug wrap 44 and the outer surface of the wrapping material 25 of the tobacco rod, using a suitable adhesive. A ventilated or air diluted smoking article is provided with an air dilution means, such as a series of perforations 50, each of which extend through the tipping material and plug wrap.

Figure 2:
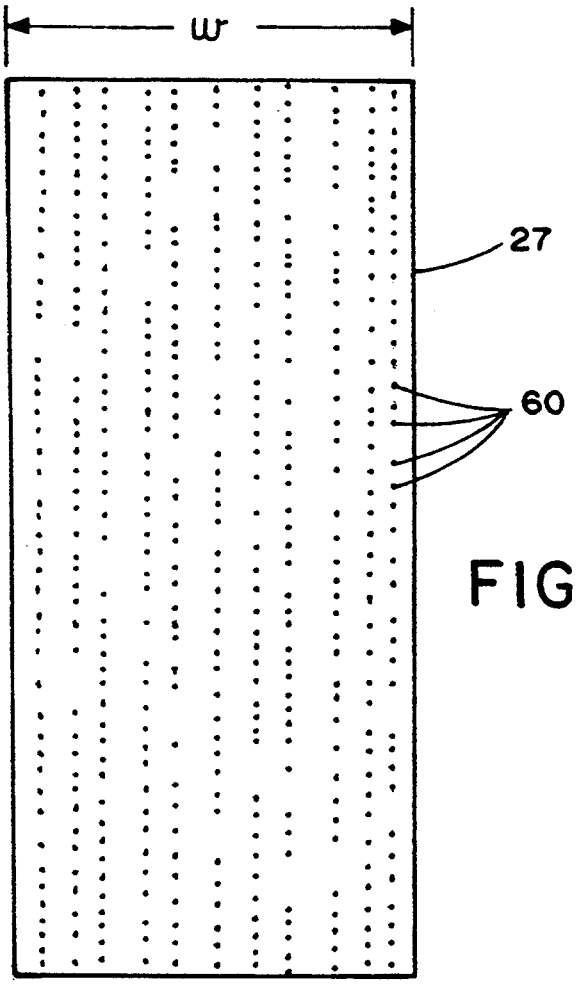
FIG. 2 is a diagrammatic illustration of one type of wrapping material which can be employed to provide a tobacco rod of the present invention.

Referring to FIGS. 1 and 2, one type of outer wrapping material 27 has a width w (shown in FIG. 2) which is equal to the circumference of the cigarette plus the lap zone of the glue line which ultimately results during cigarette manufacture. The preferred second wrapping material 27 includes a series of perforations 60 which extend in a linear fashion along the longitudinal length of thereof. Alternatively, other configurations, such as a random perforation pattern, can be provided. The size, number and relative positioning of the individual perforations 60 can vary depending upon the desired characteristics of the cigarette which has the wrapping material incorporated therein. The individual perforations are shown as enlarged in FIGS. 1 and 2.

Figure 1A:
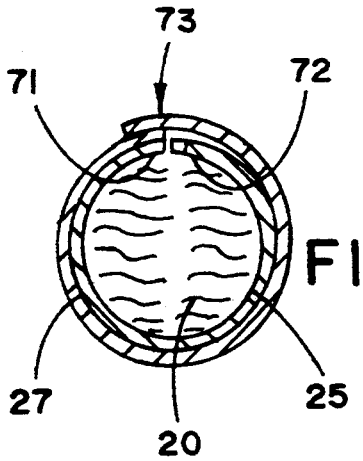
FIGS. 1A and 1B are enlarged cross-sectional radial views of two embodiments of the cigarette shown in FIG. 1 taken along line 1—1 in FIG. 1.

Referring to FIG. 1A, smokable material 20 is contained in a first circumscribing inner wrapping material 25, and a second outer wrapping material 27 circumscribes the first wrapping material. The first wrapping material 25 is formed into a circular shape such that the ends 71, 72 of the sides thereof abut one another. The ends 71, 72 of wrapping material 25 can abut one another (as shown in FIG. 1A), nearly abut one another, or slightly overlap one another. The second wrapping material 27 includes a lap zone 73 including a suitable adhesive therebetween so as to form a secure outer wrapper. As such, the width of the inner wrapping material is less than that of the outer wrapping material. A cigarette rod having such a configuration can be provided by supplying paper wrappers from two bobbins on a suitably equipped cigarette making machine, positioning the inner wrapping material on top of the outer wrapping material, passing the two wrapping materials so positioned through the garniture region of the cigarette making machine, and forming the tobacco rod. Equipment for providing a cigarette in such a manner is described in U.S. patent application Ser. No. 07/609,975 filed Nov. 6, 1990 and U.S. patent application Ser. No. 07/756,023, filed Sep. 6, 1991, which are incorporated herein by reference. Other equipment for manufacturing a cigarette in such a manner will be apparent to the skilled artisan.

Figure 1B:
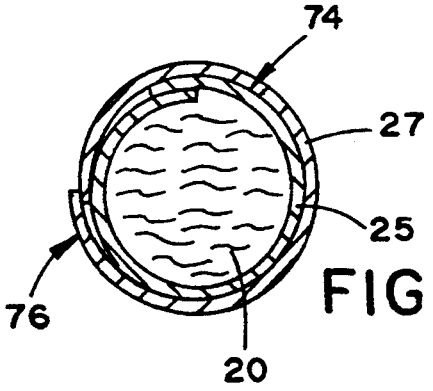

Referring to FIG. 1B, smokable material 20 is contained in a first circumscribing inner wrapping material 25, and a second outer wrapping material 27 circumscribes the first wrapping material. The first wrapping material 25 is formed into a circular shape such that a lap zone 74 including a suitable adhesive therebetween is formed. The second wrapping material includes a lap zone 76 including a suitable adhesive therebetween so as to form a secure outer wrapper. A cigarette rod having such a configuration can be provided by forming a cigarette rod using known techniques, and then wrapping the rod so formed with an outer wrapping material. Equipment for providing such a cigarette will be apparent to the skilled artisan.

Figure 3:
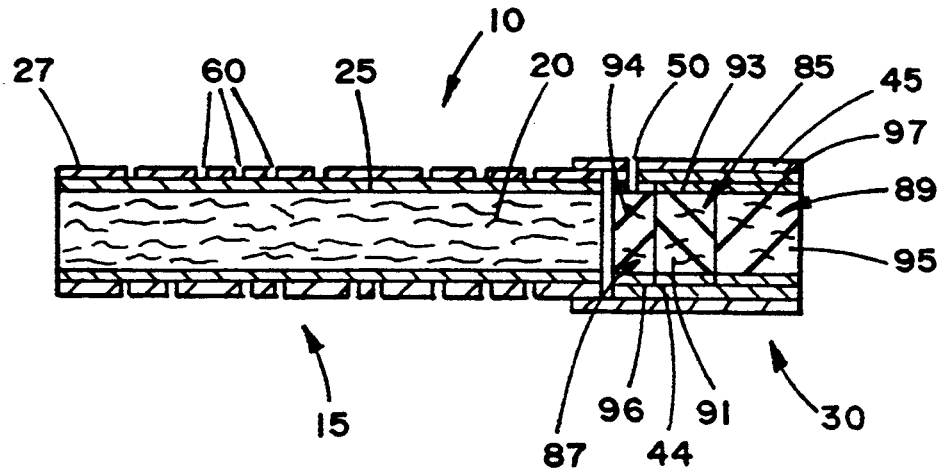
FIGS. 3-5 are longitudinal sectional views of cigarettes of the present invention.

Another preferred embodiment of a cigarette of the present invention is shown in FIG. 3. The cigarette 10 is generally similar to the cigarette described with reference to FIGS. 1, 1A, 1B and 2, except that the filter element 30 includes three filter segments which are aligned in an end-to-end relationship, preferably abutting one another. Such a filter element has a so-called "triple filter" configuration. Center filter segment 85, positioned between rod end filter segment 87 and mouthend segment 89, includes a filter material 91, such as gathered carbon paper. The rod end and mouthend filter segments 87, 89 each include filter material 94, 95, respectively. The filter materials 94, 95 typically are materials such as gathered cellulose acetate web, plasticized cellulose acetate tow, gathered polypropylene web, gathered polyester web, or polypropylene tow. The filter materials of each of the rod end and mouth end filter segments can be the same as or different from one another. The filter materials 94, 95 each are circumscribed by wrapping material 96, 97, respectively. The three filter segments are held together using circumscribing outer wrapping material 44 so as to form the filter element 30.

Figure 4:
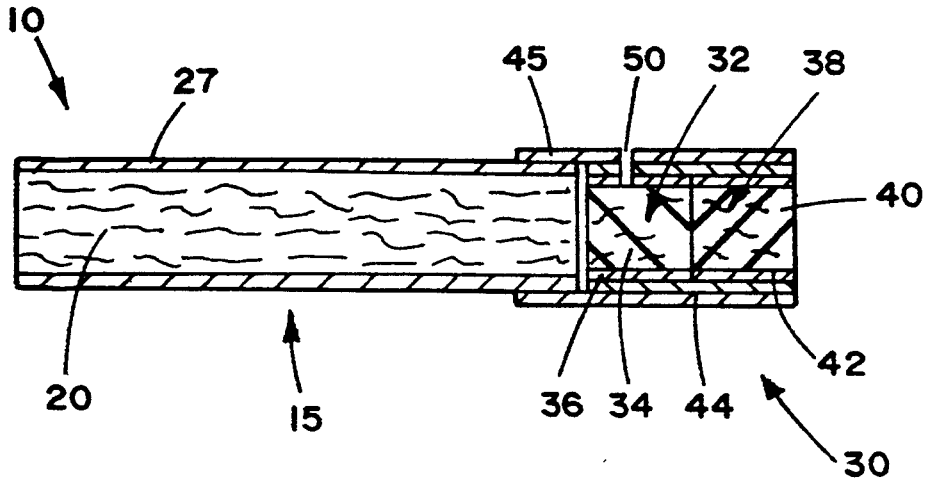

Referring to FIG. 4, there is shown a cigarette which is generally similar to that cigarette described with reference to FIG. 1, except that the tobacco rod 15 includes only one circumscribing wrapping material 27.

Figure 5:
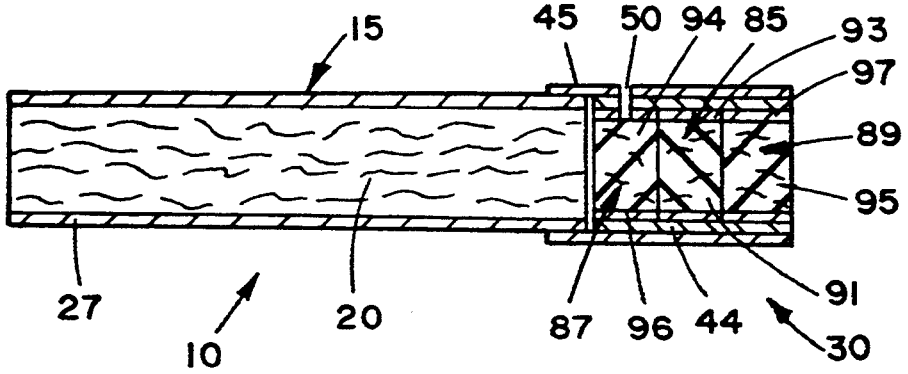

Referring to FIG. 5, there is shown a cigarette which is generally similar to that cigarette described with reference to FIG. 3, except that the tobacco rod 15 includes only one circumscribing wrapping material 27.

The smokable material employed in the manufacture of the tobacco rod can vary. For example, the smokable material of the cigarette can have the form of filler (e.g., tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacture. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut puffed stems, reconstituted tobacco materials; or blends thereof. Certain reconstituted tobacco materials are described in U.S. Pat. Nos. 4,962,774 to Thomasson et al.; 4,987,906 to Young, et al. and 5,056,537 to Brown et al.; in European Patent Application No. 419,733; and in U.S. patent application Ser. Nos. 07/647,329, filed Jan. 28, 1991 and 07/710,273, filed Jun. 4, 1991 and 07/769,914, filed Sep. 30, 1991. Certain processed tobacco materials are described in U.S. Pat. Nos. 5,025,812 to Fagg, et al. and 5,065,775 to Fagg. Certain blends are described in U.S. Pat. Nos. 4,924,888 to Perfetti, et al.; 4,942,888 to Montoya, et al.; and 4,998,541 to Perfetti, et al. Preferably, the smokable material or blend of smokable materials consists essentially of tobacco filler material or consists only of tobacco filler material. Also of particular interest are smokable materials or blends of smokable materials, that when incorporated into tobacco rods which would provide mainstream smoke which would be perceived by the smoker to be harsh, woody, papery, bitter, sour, hot and irritating when smoked in cigarettes incorporating filter elements which are not filter elements of the present invention. For example, smokable filler consisting essentially of reconstituted tobacco material, consisting only of reconstituted tobacco material, incorporating relatively high levels of tobacco stems, or incorporating high levels of reconstituted and volume expanded tobacco materials can be employed in cigarettes employing the filter elements of the present invention.

Smokable materials can be cased and top dressed as is conventionally performed during various stages of cigarette manufacture. As such, the smokable material, and particularly tobacco filler material, can include casing and/or top dressing components. For example, blend components such as flavoring agents and humectants, as well as other forms of tobacco (e.g., tobacco extracts), can be applied to the smokable material, as is commonly performed when cigarettes are manufactured. See, Leffingwell, et al., *Tobacco Flavoring For Smoking Products* (1972). Suitable flavoring agents and forms of tobacco include vanillin, tobacco extracts such as tobacco essences and tobacco aroma oils, cocoa, licorice, menthol, and the like. Flavor modifying agents such as levulinic can be applied to the smokable material (e.g., in amounts ranging from about 0.01 to about 2 percent, normally from about 0.1 to about 1 percent, preferably about 0.2 to about 0.6 percent, based on the dry weight of the smokable material). Such components conveniently are applied to the smokable material as casing and top dressing components. See, U.S. Pat. No. 4,830,028 to Lawson, et al.

Typically, the tobacco rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 mm to about 50 mm) can be employed, particularly when smokable blends having a relatively high packing density are employed.

The packing densities of the blend of smokable materials contained within the wrapping materials can vary. Typical packing densities for tobacco rods of cigarettes of the present invention range from about 150 to about 300 mg/cm$^3$. Normally, packing densities of the tobacco rods range from about 200 to about 280 mg/cm$^3$.

Exemplary tobacco rods having two layers of wrapping material circumscribing a charge of tobacco cut filler are described in Examples 1 through 32 of U.S. patent application Ser. No. 07/661,747, filed Feb. 27, 1991, and in Examples 1 through 25 of U.S. patent application Ser. No. 07/759,266, filed Sep. 13, 1991, which are incorporated herein by reference.

Typically, the filter element has a length which ranges from about 15 mm to about 40 mm, preferably about 20 mm to about 35; and a circumference of about 17 mm to about 27 mm, preferably about 22 mm to about 25 mm. The filter element can have a wide range of filtration efficiencies. Typically, the filter segment containing carbonaceous material has a low filtration efficiency for particulate matter.

For filter elements having two filter segments (e.g., as described with reference to FIGS. 1 and 4), the rod end filter segment typically has a length of about 20 to about 80 percent, preferably about 40 to about 60 percent, of the total length of filter element, while the mouthend filter segment typically has a length of about 20 to about 80 percent, preferably about 40 to about 60 percent, of the total length of the filter element. An exemplary filter element having two filter segments has a rod end segment of 12 mm length, and a mouth end segment of 15 mm length. For filter elements having three filter segments (e.g., as described with reference to FIGS. 3 and 5), the rod end filter segment typically has a length of about 15 to about 30 percent of the total length of the filter element, the mouthend filter segment typically has a length of about 15 to about 30 percent of the total length of the filter element, and the center filter segment typically has a length of about 30 to about 60 percent of the total length of the filter element. Carbonaceous material containing segments normally have lengths which range from about 10 mm to about 30 mm, preferably about 12 mm to about 25 mm, and more preferably about 13 mm to about 18 mm.

The carbonaceous material for the filter segment of the filter element preferably is provided within a paper. That paper most preferably is gathered; embossed and gathered; corrugated and gathered; or embossed, corrugated and gathered; to form the filter segment. Typically, for a filter element having a circumference of about 22 mm to about 25 mm, the carbon-containing paper which is gathered to form a filter segment has a width of about 3.5 inches to about 11 inches, and usually about 5 inches to about 8.5 inches. Gathered paper filter segments can be provided (i) using the apparatus described in U.S. Pat. No. 4,807,809 to Pryor, et al.; (ii) using the apparatus described in U.S. patent application Ser. No. 585,444, filed Sep. 20, 1990; (iii) using the apparatus generally as described by Keith, et al., in U.S. Pat. No. 4,283,186 at col. 4, line 50 through col. 5, line 6; or (iv) using a rod making unit available as CU-10, CU-20 or CU-20S from Decoufle s.a.r.b., together with a KDF-2 rod making apparatus from Hauni-Werke Korber & Co., K.G. Filter segments can be provided by simultaneously gathering two types of carbon-containing paper webs, or a carbon-containing paper web and another paper web (e.g., a paper available as P-144-50 ABS from Kimberly-Clark Corp. or a tobacco-containing paper web), so as to provide a segment having two types of gathered papers. Although not as desirable, filter segments can be provided by simultaneously gathering a carbon-containing paper web and a web of thermoplastic material (e.g., as described in U.S. Pat. Nos. 5,076,295 and 5,105,834 to Saintsing et al.; and in U.S. patent application Ser. Nos. 07/621,499, filed Dec. 7, 1990 and 07/868,925 filed Apr. 15, 1992), so as to provide a segment having two types of gathered webs. Carbon-containing filter segments then can be plug tube combined with one or more other filter segments (e.g., with a segment of gathered polypropylene web, gathered cellulose acetate web, gathered polyester web, or cellulose acetate tow) using known plug tube combination techniques.

The carbon-containing paper is gathered to form filter segments such that the cross-sectional void area of that segment typically ranges from about 5 to about 30 percent, generally from about 8 to about 25 percent, and often about 10 to about 20 percent. The cross-sectional void area (i.e., that area provided by passageways when the filter segment is viewed end-on) typically can be determined using an image analysis technique using an IBAS 2000 Image Analyzer available from Carl Ziess, Inc.

In one aspect, the gathered paper can be corrugated. Most preferably, the corrugations extend along the length of the carbon-containing paper which is gathered to provide the filter segment. The corrugation pattern can vary, and can have a wavy, square wave or sawtooth configuration, when viewed end-on. For example, the paper can be corrugated so as to have a wavy shape when viewed end on; such that the distance between each peak of the corrugation pattern is about 0.5 to about 2 mm, typically about 1 to about 1.5 mm; and such that the depth of the corrugation pattern is about 1 to about 2 mm. As another example, the paper can be corrugated such that the distance between each peak of the corrugation pattern is about 0.3 to about 1 mm, the depth of the corrugation pattern is about 0.2 to about 1 mm; and the corrugation pattern is such that each peak is slightly flattened, and each trough is slightly flattened.

The manner in which the carbon-containing paper is embossed or corrugated can vary. In certain circumstances it is desirable to moisten the paper prior to the time it is embossed or corrugated. For example, a carbon-containing paper web having a moisture content of about 10 weight percent can be sprayed with water or otherwise contacted with water so as to have a moisture content of about 30 to about 50 weight percent; the moistened paper then can be embossed or corrugated in the presence of applied heat (e.g., at about 120° C.); the moistened paper then can be dried convectively or using microwave drying techniques to a moisture content of about 10 weight percent; the dried, embossed or corrugated paper web then can be gathered into a continuous rod; and then the continuous rod can be divided into filter rods of the desired length.

The amount of carbonaceous material incorporated within a carbon-containing paper can vary. Typically, the amount of carbonaceous material within such paper is more than about 15, usually more than about 20, generally more than about 25, often more than about 30, and frequently, more than about 40 weight percent, based on the dry weight of the paper. Typically, the amount of carbonaceous material within such paper is less than about 65, often less than about 60 and frequently less than about 55 weight percent, based on the dry weight of the paper.

The amount of carbonaceous material within the filter segment containing the gathered paper containing that material typically ranges from about 20 to about 120 mg, often about 40 to about 110 mg, and frequently about 60 to about 100 mg.

Typically, the weight of carbon-containing paper within the filter segment incorporating that paper ranges from about 75 to about 250 mg, generally about 100 to about 225 mg and often about 125 to about 200 mg.

The carbonaceous material which is incorporated into the filter element can vary. Most preferred carbonaceous materials are highly activated. The degree of activation can vary, and typically is such so as to provide about 25 to about 125, more typically about 60 to about 70, weight percent pickup of carbon tetrachloride. Carbonaceous materials most useful herein have a high carbon content; consist primarily of carbon; and preferably have a carbon content above about 80 weight percent, and more preferably above about 90 weight percent. Preferred carbonaceous materials are provided by carbonizing or pyrolyzing bituminous coal, tobacco material, softwood pulp, hardwood pulp, coconut hulls, kapok fibers, cotton fibers, cotton linters, and the like. Examples of suitable carbonaceous materials are activated coconut hull based carbons available from Calgon Corp. as PCB and GRC-11. Examples of suitable carbonaceous materials are coal based carbons available from Calgon Corp. as S-Sorb, BPL, CRC-11F, FCA and SGL. Examples of suitable carbonaceous materials are wood based carbons available from Westvaco as WV-B, SA-20 and BSA-20. Other carbonaceous materials are available from Calgon Corp. as HMC, ASC/GR-1 and SC II. Another carbonaceous material includes Witco Carbon No. 637. Other carbonaceous materials are described in U.S. patent application Ser. No. 07/569,325, filed Aug. 17, 1990; U.S. Pat. Nos. 4,771,795 to White, et al. and 5,027,837 to Clearman, et al.; and European Patent Application Nos. 236,922; 419,733 and 419,981. Certain carbonaceous materials can be impregnated with substances such as silver, copper, platinum, palladium, potassium bicarbonate, tobacco extracts, polyethyleneimine, manganese dioxide, chromate salts, eugenol, and 4-ketononanoic acid.

The size of the individual carbonaceous powder, particles or granules can vary, depending upon the desired design of the filter element. The individual powdered or fine grain carbonaceous particles typically have a diameter of about 10 μm to about 250 μm, often about 20 μm to about 100 μm, and frequently about 30 μm to about 70 μm. Particularly preferred powdered or fine grain particles can be characterized as having an average diameter of about 40 μm, or such that the particles or fine grains pass through a 325 U.S. mesh screen.

The carbon-containing paper includes other materials. The paper includes at least one cellulosic material, can include at least one inorganic filler, and can include other additives or ingredients employed in the paper making industry. Exemplary cellulosic materials include flax fibers, hardwood pulp (preferably unbleached), softwood pulp (preferably unbleached), cotton fibers, tobacco parts (e.g., tobacco laminae and stem pieces), and the like. Exemplary inorganic filler materials include molecular sieve particles, agglomerated calcium carbonate particles, calcium carbonate particles, calcium sulfate fibers, precipitated magnesium hydroxide gel, clay particles, and the like. Most preferably, the materials which make up the paper are incorporated into the paper during manufacture using the paper making process. Components such as sizing agents and moisture also can be incorporated into the carbon-containing paper. Typically, the amount of sizing agent incorporated into the paper is less than about 5 weight percent, and often about 0.1 to about 3 weight percent; and the moisture content of the paper ranges from about 5 to about 15 weight percent, and often about 8 to about 12 weight percent. Flavoring agents and other smoke modifying agents (e.g., tobacco extracts, heat treated tobacco extracts, spearmint, vanillin, anethole and menthol) also can be incorporated into the carbon-containing paper. Exemplary tobacco extracts are spray dried extracts and are described in U.S. Pat. No. 5,060,669 to White et al. A preferred carbon-containing paper consists essentially of softwood pulp and carbonaceous material. Certain carbon-containing papers are absent of tobacco material. Certain carbon-containing papers are absent of inorganic fillers (e.g., calcium carbonate particles), and are absent of thermoplastic fibers (e.g., polyethylene, polypropylene or polyester fibers).

The physical properties of the carbon-containing paper can vary. The thickness of the paper typically ranges from about 0.08 mm to about 0.2 mm, often about 0.13 mm to about 0.18 mm. The basis weight of the paper typically ranges from about 35 g/m$^2$ to about 60 g/m$^2$, often about 45 g/m$^2$ to about 55 g/m$^2$. The tensile strength of the paper preferably is at least about 800 g/in, typically ranges from about 1100 g/in to about 2300 g/in, although papers having greater tensile strengths can be employed. The porosity (i.e., inherent porosity) of the paper preferably is quite high, but typically ranges from about 50 to about 300 CORESTA units, often about 70 to about 200 CORESTA units. The paper can be electrostatically perforated to provide a relatively high net permeability. Typically, papers having exceedingly low porosities have a tendency to provide relatively low removal efficiencies of gas phase components of mainstream smoke.

Exemplary carbon-containing papers are available as P-144-17AC, P-144-30AC, P-144-50AC, P-144-50 HMC, P-144-50 SGL, P-144-BSHC, P-144-BAC, P-144-50-SA20, P-144-70-KCG, P-144-70-SA20, P-2674-12-12, P-2674-13-17, P-2674-14-24, P-2674-11-3, P-2674-11-7, P-3122-6-8, P-3122-6-6, P-3122-6-5, P-3122-6-12, P-3001-72-1, and P-144-BHC from Kimberly-Clark Corp. Other carbon-containing papers are described in European Patent Application No. 342,538, which is incorporated herein by reference. Other carbon-containing papers will be apparent to the skilled artisan. For example, carbon particles can be embedded in a paper substrate and employed as a filter material for a filter segment.

The filter segment provided using a gathered carbon-containing paper includes a plurality of longitudinally extending channels or passageways, and most preferably the channels or passageways, and most preferably the channels or passageways extend the total length of the filter segment. The carbon-containing paper is gathered such that aerosol particles of the mainstream smoke pass through the longitudinally extending passageways and tend to not physically interact (e.g., impact) with the carbonaceous material within the carbon-containing paper to a significant degree; while gas phase components of the mainstream smoke exhibit a tendency to interact physically and chemically with the carbonaceous material within the carbon-containing paper to a significant degree. As the air passageways or channels are formed by gathering a paper web, the individual channels of the plurality of channels are of varying shape and size. The number of channels or passageways which extend longitudinally through the carbon-containing filter segment can vary. Typically, embossed or corrugated papers which are gathered provide a greater number of longitudinally extending channels than those papers which are simply gathered. For a rod having a circumference of about 23 mm to about 25 mm which is provided by gathering a corrugated carbon-containing paper (e.g., a paper having a width of about 5.5 inches which is corrugated), the number of longitudinally extending passageways typically ranges from about 100 to about 200, often about 120 to about 180, and frequently about 130 to about 160. Typically, the area of each of such passageways when the filter segment is viewed end-on ranges from about 0.05 to about 0.3 mm$^2$, often about 0.06 to about 0.2 mm$^2$, and frequently about 0.07 to about 0.17 mm$^2$. For a rod having a circumference of about 23 mm to about 25 mm which is provided by gathering a carbon-containing paper (e.g., a paper having a width of about 8.5 inches), the number of longitudinally extending passageways typically ranges from about 45 to about 100, often about 50 to about 95, and frequently about 60 to about 80. Typically, the area of each of such passageways when the filter segment is viewed end-on ranges from about 0.01 to about 0.2 $mm^2$, often about 0.02 to about 0.1 $mm^2$, and frequently about 0.03 to about 0.07 $mm^2$.

Preferably, the carbon-containing paper is gathered within the entire cross-sectional region of the filter segment. As such, the carbon-containing paper and air passageways provided by gathering that paper fill the entire cross-sectional region of that filter segment. In addition, the filter segment preferably is absent of any passageways of extremely large cross-sectional area. Preferably, the filter segment is absent of any air passageways having an area of more than about 1 $mm^2$, and most preferably is absent of any passageways having an area of more than about 2 $mm^2$, when the filter segment is viewed head-on.

The pressure drop of the carbon-containing filter segments of the present invention preferably is quite low. For a rod having a circumference of about 23 mm to about 25 mm, which is provided by gathering a corrugated carbon-containing paper, the pressure drop exhibited thereby typically is less than about 1, often less than about 0.5, and frequently in the range of about 0.2 to about 0.3 mm of water pressure drop at 17.5 cc/sec air flow per 1 mm length of filter segment. For a rod having a circumference of about 23 mm to about 25 mm which is provided by gathering a carbon-containing paper, the pressure drop exhibited thereby typically is less than about 2, often less than about 1.5, and frequently in the range of 0.7 to about 1.2 mm of water pressure drop at 17.5 cc/sec air flow per 1 mm length of filter segment. Typically, pressure drop values of filter rods are measured using a Filtrona Filter Test Station (CTS Series) available from Filtrona Instruments and Automation Ltd.

Typically, the tipping material circumscribes the filter element and an adjacent region of the tobacco rod such that the tipping material extends about 3 mm to about 6 mm along the length of the tobacco rod. Typically, the tipping material is a conventional paper tipping material and is adhesively secured to the filter element and the adjacent region of the tobacco rod. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of this invention, the amount of air dilution can vary. Often, the amount of air dilution for an air diluted cigarette is greater than about 10 percent, and frequently greater than about 25 percent. The upper limit of air dilution for a cigarette typically is less than about 75 percent, more frequently less than about 65 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

Cigarettes of the present invention generally provide FTC "tar" yields in the range from about 2 to about 14 mg/cigarette, although other "tar" yields are possible. Typical FTC "tar" to FTC carbon monoxide ratios for such cigarettes are less than about 1.5, and sometimes are less than about 1.2. If desired, suitable catalytic compounds for the removal of carbon monoxide can be incorporated into the filter element. Cigarettes of the present invention exhibit desirable organoleptic properties. Cigarettes having carbonaceous materials within the filter element preferably exhibit a smooth smoking character, and provide less harsh and less bitter attributes than comparable cigarettes not having such a filter element. Preferred filter elements assist in reducing the gas phase components of cigarette smoke that have a propensity to provide a harsh, irritating, stingy, sour and bitter character to mainstream tobacco smoke. As such, cigarettes of the present invention are capable of providing the smoker with mainstream smoke which is smooth tasting, exhibits good strength and body, exhibits good tobacco smoke flavor, and yields an acceptable aftertaste. The filter elements of the present invention are capable of removing condensable gas phase components from mainstream tobacco smoke to a significant degree. Condensable gas phase components include organic compounds such as carbonyl compounds (e.g., acetone, formaldehyde, acrolein and acetaldehyde). Cigarettes of the present invention typically exhibit yields of certain mainstream condensable gas phase components which are less than 30 percent, frequently are less than 50 percent, and often are less than 70 percent that of those yields of a cigarette of similar format and configuration but employing a paper filter segment not incorporating the carbonaceous material used according to the present invention. Typically, certain cigarettes of the present invention, when smoked under FTC smoking conditions can provide yields of condensable gas phase components (e.g., gas phase carbonyl compounds, such as acetone, formaldehyde, acetaldehyde and acrolein) to wet total particulate matter (i.e., WTPM) of less than about 70 μg/mg, often less than about 60 μg/mg, and frequently less than 50 μg/mg.

Filter segments incorporating carbonaceous materials also can be incorporated in those types of cigarettes described in U.S. Pat. Nos. 5,027,837 to Clearman et al.; 4,714,082 to Banerjee et al.; 4,756,318 to Clearman et al.; 4,793,365 to Sensabaugh, Jr., et al.; 4,854,331 to Banerjee et al. and 4,881,556 to Clearman et al.; as well as U.S. patent application Ser. Nos. 07/882,209, filed May 13, 1992; 07/873,529, filed Apr. 21, 1992; 07/856,239, filed Mar. 25, 1992; 07/800,679, filed Nov. 27, 1991; 07/723,350, filed Jun. 28, 1991 and 07/576,751, filed Aug. 29, 1990, now U.S. Pat. No. 5,065,776; which are incorporated herein by reference.

The following examples are provided in order to further illustrate the invention but should not be construed as limiting the scope thereof. Unless otherwise noted, all parts and percentages are by weight.

EXAMPLE 1

Cigarettes substantially as shown in FIG. 1 are provided as follows:

The cigarettes each have a length of about 84 mm and a circumference of about 24.7 mm. The tobacco rod has a length of about 57 mm, and the filter element has a length of about 27 mm. Each filter element includes a first 15 mm segment of gathered carbon paper and a second 12 mm segment of cellulose acetate tow. The first segment is a 8.5 inch wide carbon/tobacco paper available as P-144-BAC from Kimberly-Clark Corp., which is gathered using the apparatus described in Example 1 of U.S. Pat. No. 4,807,809 to Pryor, et al. and circumscribed by paper plug wrap. The second segment includes triacetin plasticized cellulose acetate tow (8.0 denier per filament/40,000 total denier) circumscribed by paper plug wrap. The two segments are plug tube combined into a filter element using circumscribing paper plug wrap.

The smokable material is a blend of 17 parts flue-cured tobacco cut filler and 83 parts of another smokable filler material. The other smokable material is a cut filler material obtained by casting and drying an aqueous slurry including 5 percent sodium carboxymethylcellulose, 6 percent glycerin, and 89 percent of an agglomerated material of carbonaceous material and calcium carbonate of the type described in European Patent Application No. 419,733.

The smokable material is circumscribed by a tobacco-containing paper available as P-2249-115 from Kimberly-Clark Corp. The tobacco-containing paper is circumscribed by a paper of the type described at col. 19, lines 16–23 of European Patent Application No. 419,733.

The filter element is attached to the tobacco rod using non-porous tipping paper. The cigarette is not air diluted.

EXAMPLE 2

Cigarettes are provided as described in Example 1. However, the tobacco-containing paper inner wrap of the tobacco rod is a tobacco-containing paper available as P-2674-157 from Kimberly-Clark Corp.; and the carbon/tobacco paper of the filter element is a gathered paper containing activated coconut hull carbon and available as P-144-17AC from Kimberly-Clark Corp.

EXAMPLE 3

Cigarettes are provided as described in Example 1. However, the inner wrap of the tobacco rod is available as P-2674-157 from Kimberly-Clark Corp.; and the paper of the first filter element is a gathered carbon-containing paper available as P-144-21AC from Kimberly-Clark Corp.

EXAMPLE 4

Cigarettes are provided as described in Example 1. However, the inner wrap of the tobacco rod is available as P-2674-157 from Kimberly-Clark Corp.; and the paper of the first filter element is a gathered carbon-containing paper available as P-144-33AC from Kimberly-Clark Corp.

EXAMPLE 5

Cigarettes are provided as described in Example 1. However, the inner wrap of the tobacco rod is available as P-2674-157 from Kimberly-Clark Corp.; and the gathered paper of the first filter element is a gathered soft wood pulp/carbon paper having a thickness of about 0.005 inch available as P-144-50AC from Kimberly-Clark Corp.

EXAMPLE 6

Cigarettes substantially as shown in FIG. 1 are prepared as follows:

The cigarettes each have a length of about 84 mm and a circumference of about 24.8 mm, and include a tobacco rod having a length of about 57 mm and a filter element having a length of about 27 mm. Each filter element includes a filter segment of gathered carbon-containing paper and a filter segment of cellulose acetate tow. The first filter segment has a length of about 15 mm, and includes carbon paper available as P-144-50AC from Kimberly-Clark Corp. gathered as described in Example 1. The second filter segment has a length of about 12 mm, and includes triacetin plasticized cellulose acetate tow (2.7 denier per filament/48,000 total denier). The filter material of each filter segment is circumscribed by paper plug wrap. The two filter segments are combined by a circumscribing paper plug wrap.

The smokable material is a blend of 85 parts flue-cured tobacco cut filler and 15 parts Samsun Oriental tobacco cut filler. The smokable material has a casing formula applied thereto in order that the cut filler blend has in contact therewith 0.35 percent licorice powder, 0.92 percent glycerine, 0.45 percent propylene glycol, 0.62 percent St. John's Bread (light roast) powder, 0.23 percent absolute cocoa from Robertet, Inc., 0.92 percent Fig Supreme Flavor from Bell Flavors, In., and 1.05 percent potassium carbonate. Then, the cased blend is volume expanded using the G-13 process of R. J. Reynolds Tobacco Company to provide a cased, puffed tobacco blend.

About 320 mg of the tobacco blend is circumscribed by a tobacco containing paper available as P-2831-189-B4-6606 from Kimberly-Clark Corp. The paper includes wood pulp as well as flue-cured, Burley and Basma Oriental tobacco pieces. The tobacco containing paper is in turn circumscribed by an outer paper wrap available as Reference No. 854 from Kimberly-Clark Corp. The resulting tobacco rod weighs about 0.54 g.

The filter element is attached to one end of the tobacco rod using circumscribing non-porous tipping paper. The cigarette is air diluted 33 percent by providing a ring of perforations about 13 mm from the extreme mouthend of the cigarette.

The cigarette yields 7.3 puffs when smoked under FTC smoking conditions.

EXAMPLE 7

Cigarettes are provided as described in Example 1. However, the outer wrap of the tobacco rod is available as DD-100-2 from Kimberly-Clark Corp. The inner wrap of the tobacco rod is available as P-2674-157 from Kimberly-Clark Corp., the first filter segment is a 15 mm long segment provided by gathering an 8.5 inch wide web of carbon-containing paper available as P-144-50AC from Kimberly-Clark Corp. using a rod making apparatus, the second filter segment is a 12 mm long segment of cellulose acetate tow (2.7 denier per filament/48,000 total denier), and the smokable blend is that blend described in Example 6.

EXAMPLE 8

Cigarettes substantially as shown in FIG. 4 are provided as follows:

The cigarettes each have a length of about 84 mm and a circumference of about 24.8 mm. The tobacco rod has a length of about 57 mm, and the filter element has a length of about 27 mm. Each filter element includes a first 12 mm segment of gathered carbon paper and a second 15 mm segment of cellulose acetate town. The first segment is a 8.5 inch wide carbon-containing paper available as P-144-17AC from Kimberly-Clark Corp., which is gathered using the apparatus described in Example 1 of U.S. Pat. No. 4,807,809 to Pryor et al., and circumscribed by paper plug wrap. The second segment includes triacetin plasticized cellulose acetate tow (2.7 denier per filament/48,000 total denier) circumscribed by paper plug wrap. The two segments are plug tube combined into a filter element using circumscribing paper plug wrap.

The smokable material is an American blend of tobacco cut filler which has been cased and top dressed. The smokable material is circumscribed by a paper wrap available as Reference No. 854 from Ecusta Corp.

The filter element is attached to the tobacco rod using tipping paper. The cigarette is ventilated to about 38 percent air dilution by providing a ring of 12 perforations through the tipping paper and plug wrap about 13 mm from the extreme mouthend of the cigarette.

EXAMPLE 9

Cigarettes are provided as described in Example 8. However, the carbon-containing paper within the first filter segment is available as P-144-30AC from Kimberly-Clark Corp.

EXAMPLE 10

Cigarettes are provided as described in Example 8. However, the carbon-containing paper within the first filter segment is available as P-144-50AC from Kimberly-Clark Corp.

EXAMPLE 11

Cigarettes are provided as described in Example 10. However, the second segment includes triacetin plasticized cellulose acetate tow (2.1 denier per filament/48,000 total denier), and the cigarette is ventilated to about 28 percent air dilution.

EXAMPLE 12

Cigarettes are provided as described in Example 10. However, the first segment includes a corrugated carbon-containing paper (i.e., P-144-50AC) of 5.5 inch width, and the cigarette is not ventilated. The corrugations to the carbon-containing paper have a wavy pattern when the paper is viewed end-on. The corrugation pattern is such that the distance between each peak is about 1.5 mm, and the depth of each corrugation is about 1 mm. The carbon-containing paper is treated with water to a moisture content of about 40 percent, passed through two corrugating rollers each having a wavy surface face so as to have a "tooth" and "well" configuration, convectively dried to a moisture level of about 10 percent, and gathered using rod making unit available as a CU-20 from Decoufle s.a.r.b. together with a KDF-2 rod making apparatus from Hauni-Werke Korber & Co., K.G.

EXAMPLE 13

Cigarettes are provided as described in Example 8. However, the carbon-containing paper within the first filter segment is available as P-144-50 SGL from Kimberly-Clark Corp., and the cigarette is not ventilated.

EXAMPLE 14

Cigarettes are provided as described in Example 8. However, the carbon-containing paper within the first filter segment is available as P-144-50 HMC from Kimberly-Clark Corp., and the cigarette is not air diluted.

EXAMPLE 15

Cigarettes are provided as described in Example 12. However, the cigarette is not air diluted.

EXAMPLE 16

Cigarettes are provided as described in Example 15. However, the carbon-containing paper is available as P-144-17AC from Kimberly-Clark Corp.

EXAMPLE 17

Cigarettes are provided as described in Example 15. However, the carbon-containing paper is available as P-144-30AC from Kimberly-Clark Corp.

EXAMPLE 18

Cigarettes are provided as described in Example 12. However, the second filter segment is plasticized cellulose acetate tow (2.1 denier per filament/48,000 total denier) which is manufactured using tow processing equipment to provide a 96 mm filter rod having a pressure drop of 600 mm water pressure drop at 17.5 cc/sec air flow rate. The first filter segment is provided as described in Example 12. The cigarette is ventilated to about 60 percent air dilution by providing 2 rows of perforations of 8 perforations each positioned 13 mm and 15 mm from the extreme mouthend of the cigarette.

The cigarette is smoked under FTC smoking conditions, and yields about 11.1 puffs, about 9.65 mg WTPM, about 7.93 mg "tar", about 1 mg nicotine, and about 5.68 mg carbon monoxide. The cigarette yields reduced levels of carbonyl compounds as compared to a similar cigarette not employing the gathered carbon-containing filter segment.

EXAMPLE 19

Cigarettes substantially as shown in FIG. 1 are prepared as follows:

The cigarettes each have a length of about 84 mm and a circumference of about 24.8 mm, and include a tobacco rod having a length of 57 mm and a filter element having a length of about 27 mm. Each filter element includes a filter segment of gathered carbon paper and a filter segment of cellulose acetate tow. The first filter segment has a length of about 12 mm, and includes a gathered carbon-containing paper available as P-144-BHC from Kimberly-Clark Corp. circumscribed by Reference No. 646 nonporous paper plug wrap from Kimberly-Clark Corp. The carbon paper is a carbon/-tobacco paper containing about 17 percent PCB carbon of about 40 micron diameter. The first filter segment is provided by gathering an 8.5 inch width web of carbon paper as described in Example 1 of U.S. Pat. No. 4,807,809 to Pryor, et al. The second filter segment has a length of about 15 mm, and includes triacetin plasticized cellulose acetate tow. The cellulose acetate tow is circumscribed by nonporous paper plug wrap. The tow item is 1.2 denier per filament/48,000 total denier. Each first and second filter segment are attached together in an end-to-end relationship using a circumscribing nonporous plug wrap to provide a filter element. Each filter element is attached to each tobacco rod using nonporous tipping paper. For each cigarette, the tipping paper circumscribes the filter element and about a 4 mm length of the tobacco rod in the region adjacent the filter element. The filter elements are ventilated to about 55 percent air dilution by providing a ring of mechanical perforation around the paper wrapping materials of the filter element about 13 mm from the extreme mouthend of the cigarette The smokable blend consists of tobacco material which has been cased with a casing mixture. The tobacco material has the form of a so-called "American blend," and includes flue-cured, Burley and Oriental tobaccos as well as reconstituted tobacco from a papermaking process, and volume expanded flue-cured and Burley tobaccos. The blend of tobacco materials is cased using a mixture of glycerin, water and flavors. The blend is in the form of strands or shreds cut at about 25 cuts per inch (i.e., in cut filler form) and is equilibrated to a moisture level of about 12.5 percent. Each cigarette rod includes about 650 mg tobacco material.

The second or outer cigarette paper wrap is a 70 to 75 parts wood pulp and 25 to 30 parts calcium carbonate paper available as P-3122-40EP from Kimberly-Clark Corp. The paper wrap exhibits a net air permeability of abut 55 CORESTA units provided by electrostatic perforation, and a basis weight of about 35.5 g/m$^2$. The paper wrap includes about 1.3 percent ammonium alginate, about 0.4 percent Hercon 70 from Hercules Inc. and about 4.4 percent potassium citrate applied thereto, and the paper exhibits an inherent permeability (i.e., a porosity prior to electrostatic perforation) of about 1 CORESTA unit.

The first or inner cigarette paper wrap is available as P-3284-11 from Kimberly-Clark Corp. The paper wrap includes tobacco parts, wood pulp and calcium carbonate particles. The inner paper wrap is absent of added burn chemical in the form of added water soluble salt. The paper is light brown in color, has a somewhat rough surface texture, and exhibits an inherent permeability of about 50 CORESTA units.

The tobacco rod is such that the inner wrap circumscribes the smokable blend and the outer wrap circumscribes the inner wrap. The inner and outer wraps directly contact one another (i.e., the inner surface of the outer wrap contacts the outer surface of the inner wrap.)

The cigarettes are employed by burning the tobacco rod such that the blend of smokable material within the paper wrapper burns to yield smoke. When employed, such cigarettes yield very low levels of visible sidestream smoke and sustains smolder under static burning conditions after the lighting puff such that the total burnable length of the tobacco rod is consumed (i.e., the cigarette does not self-extinguish).

EXAMPLE 20

Cigarettes are provided as described in Example 19. However, the outer paper wrap of the tobacco rod is available as TOD 05504 from Ecusta Corp.; the inner wrap of the tobacco rod is available as P-2540-195 from Kimberly-Clark Corp., and the cigarette is air diluted to an air dilution level of about 50 percent.

The outer paper wrap is a heavy weight sheet, low visible sidestream paper. The base sheet contains about 15 percent calcium carbonate, about 25 percent magnesium hydroxide and about 60 percent flax fiber. The paper has an inherent permeability of about 10 CORESTA units and a basis weight of about 48 g/m$^2$. The paper has an aqueous solution including 2 percent malic acid and 12 percent potassium chloride incorporated therein using a size press. The paper includes about 45 mg potassium ions per gram of dry base sheet and about 1.3 percent malate ion analyzed in the paper (i.e., added to the paper as malic acid). The level of potassium ions in the paper is significantly greater than the level of sodium ions in the paper. The paper is electrostatically perforated so as to yield a net porosity of about 110 CORESTA units.

EXAMPLE 21

Cigarettes are provided as described in Example 20. However, the inner wrap of the tobacco rod is available as P-2540-194 from Kimberly-Clark Corp.; the first filter segment is provided by gathering a carbon-containing paper web 8.5 inches wide and available as P-144-BSHC from Kimberly-Clark Corp., and the second filter segment includes plasticized cellulose acetate tow (2.7 denier per filament/48,000 total denier). The cigarette is air diluted about 50 percent.

EXAMPLE 22

Cigarettes are provided as described in Example 20. However, the first filter segment is provided by gathering a carbon-containing paper web 8.5 inches wide available as P-144-50AC from Kimberly-Clark Corp.

EXAMPLE 23

A cigarette of the type generally described in U.S. patent application Ser. No. 07/882,209, filed May 13, 1992. However, the cigarette includes a mouthend piece including a 20 mm segment of triacetin-plasticized cellulose acetate tow (8.0 denier per filament/15,000 total denier) at the extreme mouthend of the cigarette, a 20 mm segment of reconstituted tobacco cut filler provided as described in U.S. patent application Ser. No. 07/710,273, filed Jun. 4, 1991, and a 10 mm segment of gathered carbon-containing paper. The paper is available as P-144-17AC from Kimberly-Clark Corp.

EXAMPLE 24

A cigarette is provided as described in Example 23. However, the gathered carbon-containing paper is available as P-144-30AC from Kimberly-Clark Corp.

EXAMPLE 25

A cigarette is provided as described in Example 23. However, the gathered carbon-containing paper is available as P-144-KGB-50 from Kimberly-Clark Corp., and is corrugated generally as described in Example 12.

What is claimed is:

1. A cigarette comprising a tobacco rod connected to a filter element having two ends and a cross-sectional area, said filter element comprising at least first and second separately formed filter segments positioned in longitudinal abutting relation, said first filter segment having a mouth end and comprising a gathered web of a paper including a carbonaceous material, the paper being gathered so as to form a plurality of longitudinal channels each having a longitudinal axis, each channel being open from end to end of said first filter segment alone the longitudinal axis thereof, each channel further having a cross-sectional void area, the total cross-sectional void area of said open channels comprising more than about 5 percent of the cross-sectional area of the first filter segment such that at least some mainstream smoke from the tobacco rod passes through the open channels in the first filter segment, the cross-sectional area of the first filter segment being entirely filled with the carbonaceous paper material and said open channels, said second filter segment comprising a filamentary tow material abutting the mouth end of the first filter segment, said second filter segment having a draw resistance such that the cigarette has a total pressure drop of between about 50 to about 200 mm of water at 17.5 cc/sec. air

2. The cigarette of claim 1 wherein the first filter segment including the gathered web of paper including a carbonaceous material exhibits a pressure drop of less than 2 mm water pressure drop at 17.5 cc/sec air flow per 1 mm length of filter segment.

3. The cigarette of claim 1 wherein each channel has a cross-sectional void area of about 0.05 $mm^2$ to about 0.3 $mm^2$.

4. The cigarette of claim 1 wherein the filter segment is devoid of any channels having a cross-sectional void area of more than about 2 $mm^2$.

5. The cigarette of claim 1 wherein the filter element has a circumference of about 23 mm to about 25 mm, and the first filter segment includes about 100 to about 200 channels.

6. The cigarette of claim 1 wherein the filter element has a circumference of about 23 mm to about 25 mm, and the first filter segment includes about 45 to about 100 channels.

7. The cigarette of claim 1 wherein the paper includes more than about 20 weight percent carbonaceous material, based on the dry weight of the paper.

8. The cigarette of claim 1 wherein the paper includes more than about 30 weight percent carbonaceous material, based on the dry weight of the paper.

9. The cigarette of claim 1 or 6 wherein the paper is corrugated.

10. The cigarette of claim 1 wherein the carbonaceous material within the first filter segment is an amount of about 75 to about 250 mg.

11. The cigarette of claim 1 wherein the paper consists essentially of wood pulp and carbonaceous material.

12. The cigarette of claim 1 wherein the paper exhibits a tensile strength of at least about 800 g/in.

13. The cigarette of claim 1 wherein the paper exhibits an inherent porosity of about 50 to about 300 CORESTA units.

14. The cigarette of claim 3 or 4 wherein the filter element including the gathered web of paper including a carbonaceous material exhibits a pressure drop of less than 2 mm water pressure drop at 17.5 cc/sec air flow per 1 mm length of filter element having that paper.

15. The cigarette of claim 3 or 4 wherein the carbonaceous material within the first filter segment is an amount of about 75 mg to about 250 mg.

16. The cigarette of claim 3 or 4 wherein the paper includes more than about 30 weight percent carbonaceous material, based on the dry weight of the paper.

17. The cigarette of claim 3 or 4 wherein the carbonaceous material has a carbon content above about 90 weight percent.

18. The cigarette of claim 3 or 4 wherein the paper has a basis weight of about 35 $g/m^2$ to about 60 $g/m^2$.

19. The cigarette of claim 1, 2, 5 or 7 wherein the carbonaceous material has a carbon content about 90 weight percent.

20. The cigarette of claim 8 wherein the carbonaceous material with the paper is less than about 65 percent, based on the dry weight of the paper.

21. The cigarette of claim 1, 2, 3, 4, 5 or 7 wherein the carbonaceous material has the form of particles having a diameter of about 20 $\mu m$ to about 100 $\mu m$.

22. The cigarette of claim 1, 2, 3, 4, 5 or 7 wherein the carbonaceous material has the form of particles having a diameter of about 30 $\mu m$ to about 70 $\mu m$.

23. The cigarette of claim 1, 2, 3 or 4 wherein the filter element has a circumference of about 23 mm to about 25 mm, and the gathered web of paper is provided from a web having a width of about 5 inches to about 8.5 inches.

24. The cigarette of claim 1 or 2 wherein the paper has a basis weight of about 35 $g/m^2$ to about 60 $g/m^2$.

25. The cigarette of claim 1 or 3 wherein the total cross-sectional void area of the channels is about 10 to about 30 percent of the cross-sectional area of the first filter segment.

26. The cigarette of claim 1, 2 or 10 wherein the paper has a thickness of about 0.08 mm to about 0.2 mm.

27. The cigarette of claim 1, wherein the total cross-sectional void area is up to about 30 percent.

28. The cigarette of claim 1, wherein the longitudinal length of the first filter segment is 10–30 millimeters.

29. The cigarette of claim 1, wherein the web of gathered paper has a width of 3.5 to 11 inches.

* * * * *

UNITED STATES PATENT AND TRADEMARK OFFICE

CERTIFICATE OF CORRECTION

PATENT NO. : 5,360,023

DATED : November 1, 1994

INVENTOR(S) : Richard L. Blakley et al

It is certified that error appears in the above-indentified patent and that said Letters Patent is hereby corrected as shown below:

Col. 19, line 2, "alone" should be --along--.

Col. 19, line 16, after "air", insert --flow--.

Signed and Sealed this

Ninth Day of May, 1995

Bruce Lehman

*Attest:*

BRUCE LEHMAN

*Attesting Officer*

*Commissioner of Patents and Trademarks*